US006852956B2

(12) United States Patent
Rock et al.

(10) Patent No.: US 6,852,956 B2
(45) Date of Patent: Feb. 8, 2005

(54) FABRIC WITH HEATED CIRCUIT PRINTED ON INTERMEDIATE FILM

(75) Inventors: Moshe Rock, Brookline, MA (US); Vikram Sharma, Stoneham, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 354 days.

(21) Appl. No.: 10/082,855

(22) Filed: Feb. 25, 2002

(65) Prior Publication Data

US 2002/0117494 A1 Aug. 29, 2002

Related U.S. Application Data

(60) Continuation-in-part of application No. 10/082,465, filed on Feb. 25, 2002, which is a continuation-in-part of application No. 09/791,237, filed on Feb. 23, 2001, now Pat. No. 6,414,286, which is a continuation-in-part of application No. 09/697,100, filed on Oct. 26, 2000, now Pat. No. 6,373,034, which is a continuation-in-part of application No. 09/468,627, filed on Dec. 21, 1999, now Pat. No. 6,215,111, which is a continuation-in-part of application No. 09/395,326, filed on Sep. 13, 1999, now Pat. No. 6,160,246, which is a division of application No. 09/296,375, filed on Apr. 22, 1999, now abandoned, application No. 10/082,855, which is a continuation-in-part of application No. 09/592,235, filed on Jun. 12, 2000, now Pat. No. 6,548,789, and a continuation-in-part of application No. 09/389,761, filed on Sep. 2, 1999, now Pat. No. 6,389,681, which is a division of application No. 09/298,722, filed on Apr. 23, 1999, now Pat. No. 6,111,233.

(60) Provisional application No. 60/270,847, filed on Feb. 23, 2001, now abandoned.

(51) Int. Cl.[7] ..... H05B 3/54

(52) U.S. Cl. ..... 219/545; 219/528; 219/529; 219/544

(58) Field of Search ..... 219/545, 211, 219/212, 217, 528, 529, 544, 549; 392/425, 432, 435; 34/60; 2/2.11

(56) References Cited

U.S. PATENT DOCUMENTS

| | | | |
|---|---|---|---|
| 975,359 | A | 11/1910 | Hefter |
| 1,553,461 | A | 9/1925 | Negromanti |
| 1,744,327 | A | 1/1930 | Moore |
| 1,965,542 | A | 7/1934 | Colvin, Jr. |
| 2,025,586 | A | 12/1935 | Hall |
| 2,203,918 | A | 6/1940 | Moberg |
| 2,381,218 | A | 8/1945 | Jacob |
| 2,392,470 | A | 1/1946 | Fitzmaurice |
| 2,432,785 | A | 12/1947 | Moberg |
| 2,458,801 | A | 1/1949 | Schwartz |
| 2,581,212 | A | 1/1952 | Spooner, Jr. |
| 2,670,620 | A | 3/1954 | Goldstaub |
| 2,862,097 | A | 11/1958 | Negromanti |
| 2,945,115 | A | 7/1960 | Weitzel |
| 3,425,020 | A | 1/1969 | Toyooka et al. |
| 3,472,289 | A | 10/1969 | Webber et al. |
| 3,478,422 | A | 11/1969 | Inui |
| 3,513,297 | A | 5/1970 | Jordan |
| 3,528,874 | A | 9/1970 | Spencer |
| 3,697,728 | A | 10/1972 | Stirzenbecher |

(List continued on next page.)

FOREIGN PATENT DOCUMENTS

| | | |
|---|---|---|
| DE | 2 251 207 | 5/1974 |
| DE | 197 45 889 A1 | 4/1999 |
| DE | 299 01 225 | 5/1999 |
| EP | 0 571 978 A1 | 1/1993 |
| EP | 0 548 574 A2 | 6/1993 |
| FR | 2 740 934 | 5/1997 |

*Primary Examiner*—Fadi H. Dahbour
(74) *Attorney, Agent, or Firm*—Fish & Richardson P.C.

(57) ABSTRACT

An electric heating/warming element consists of a water-resistant, vapor permeable bladder containing an electrical heating/warming circuit that generates heat when attached to a source of electrical power.

19 Claims, 2 Drawing Sheets

U.S. PATENT DOCUMENTS 3,721,799 A 3/1973 Carlstrom
3,729,613 A 4/1973 Deloire et al.
3,859,506 A 1/1975 Weckstein
3,869,596 A 3/1975 Howie
3,978,183 A 8/1976 Erickson
4,021,640 A 5/1977 Gross et al.
4,044,221 A 8/1977 Kuhn
4,061,898 A 12/1977 Murray et al.
4,063,069 A 12/1977 Perri
4,065,660 A 12/1977 Berard
4,245,149 A 1/1981 Fairlie
4,250,397 A 2/1981 Gray et al.
4,272,673 A 6/1981 Semanaz et al.
4,320,286 A 3/1982 Borrup
4,375,009 A 2/1983 Fearnside et al.
4,398,462 A 8/1983 Okano
4,459,461 A 7/1984 Spencer
4,481,881 A 11/1984 Okano
4,485,297 A 11/1984 Grise et al.
4,523,086 A 6/1985 Eilentropp
4,533,821 A 8/1985 Sato
4,538,054 A 8/1985 De la Bretoniere
4,564,745 A 1/1986 Deschenes
4,577,094 A 3/1986 Mills
4,590,359 A 5/1986 Mobius
4,607,154 A 8/1986 Mills
4,656,334 A 4/1987 Endo et al.
4,656,339 A 4/1987 Grise
4,713,531 A 12/1987 Fennekels et al.
4,736,088 A 4/1988 Bart
4,764,665 A 8/1988 Orban et al.
4,774,397 A 9/1988 Grise
4,792,662 A 12/1988 Kitagaki et al.
4,814,586 A 3/1989 Grise
4,849,255 A 7/1989 Grise et al.
4,857,384 A 8/1989 Mio et al.
4,888,089 A 12/1989 Marstiller et al.
4,892,998 A 1/1990 Marstiller et al.
4,912,306 A 3/1990 Grise et al.
4,950,868 A 8/1990 Moss et al.
4,983,814 A 1/1991 Ohgushi et al.
5,003,630 A * 4/1991 Bassick et al. ..... 2/2.11
5,019,797 A 5/1991 Marstiller et al.
5,073,688 A 12/1991 McCormack
5,081,339 A 1/1992 Stine
5,081,341 A 1/1992 Rowe
5,151,578 A 9/1992 Phillips
5,298,722 A 3/1994 Tanaka
5,319,950 A 6/1994 Whitt et al.
5,321,960 A 6/1994 Whitt et al.
5,364,678 A 11/1994 Lumb et al.
5,412,181 A 5/1995 Giamati
5,422,462 A 6/1995 Kishimoto
5,432,322 A 7/1995 Ingram et al.
5,484,983 A 1/1996 Roell
5,573,687 A 11/1996 Tanaka
5,582,757 A 12/1996 Kio et al.
5,675,911 A * 10/1997 Moser ..... 34/60
5,679,277 A 10/1997 Niibe et al.
5,858,530 A 1/1999 McCullough, Jr.
5,918,319 A 7/1999 Baxter
5,925,275 A 7/1999 Lawson
5,977,517 A 11/1999 Grosjean
6,031,212 A * 2/2000 Westerman et al. ..... 219/528
6,111,233 A 8/2000 Rock et al.
6,160,246 A 12/2000 Rock et al.
6,229,123 B1 5/2001 Knockman et al.

* cited by examiner

FABRIC WITH HEATED CIRCUIT PRINTED ON INTERMEDIATE FILM

TECHNICAL FIELD

This application claim benefit from U.S. Provisional Application No. 60/270,847, filed Feb. 23, 2001, now abandoned. This application is also: a continuation-in-part of U.S. application Ser. No. 10/082,465, filed Feb. 25, 2002, which is a continuation-in-part of U.S. application Ser. No. 09/791,237, filed Feb. 23, 2001, now U.S. Pat. No. 6,414,286, which is a continuation-in-part of U.S. application Ser. No. 09/697,100, filed Oct. 26, 2000, now U.S. Pat. No. 6,373,034, issued Apr. 16, 2002, which is a continuation-in-part of U.S. application Ser. No. 09/468,627, filed Dec. 21, 1999, now U.S. Pat. No. 6,215,111, issued Apr. 10, 2001, which is a continuation-in-part of U.S. application Ser. No. 09/395,326, filed Sep. 13, 1999, now U.S. Pat. No. 6,160,246, issued Dec. 12, 2000, which is a division of U.S. application Ser. No. 09/296,375, filed Apr. 22, 1999, now abandoned. This application is also: a continuation-in-part of U.S. application Ser. No. 09/592,235, filed Jun. 12, 2000, now U.S. Pat. No. 6,548,789. This application is also: a continuation-in-part of U.S. application Ser. No. 09/389,761, filed Sep. 2, 1999, now U.S. Pat. No. 6,389,681, issued May 21, 2002, which is a division of U.S. application Ser. No. 09/298,722, filed Apr. 23, 1999, now U.S. Pat. No. 6,111,233, issued Aug. 29, 2000. The complete disclosures of all of the above-listed patents and patent applications, and also of U.S. Pat. No. 6,307,189, issued Oct. 23, 2001, are incorporated herein by reference.

This invention relates to flexible electric heating/warming elements suitable for use in fabric articles such as clothing and footwear, blankets, heating pads and home furnishings.

BACKGROUND

It has been known to provide electrical heating /warming in flexible fabric articles such as clothing and blankets, including by incorporating elements of electrical heating/warming circuits directly into the fabric, by attaching elements of the electrical circuit to the fabric or to an intermediate substrate, or by inserting the electrical circuit, or elements thereof, between layers of fabric. It has also been known to provide an electrical heating/warming circuit secured between layers of fabric material, including for protection of the circuit. For example, Gross et al. U.S. Pat. No. 3,906,185 describes a heating circuit for footwear printed on a layer of a plastic, e.g., polyethylene, and covered by a layer of plastic of same material. Gross et al. U.S. Pat. No. 4,021,640 describes a heating circuit for a glove printed on MYLAR® film and covered with plastic film for electrical insulation. Smith U.S. Pat. No. 3,657,519 describes a heated diving suit formed of stretchable electrically conductive material, e.g. neoprene rubber containing conductive particles of silver or carbon, disposed between waterproof, electrically insulating, stretchable coating layers, e.g., latex, polyurethane or butyl rubber. St. Cyr U.S. Pat. No. 2,210,618 describes a medical device in which wire-heating elements are disposed between layers of cambric and heavy silk. Zhao U.S. Pat. No. 5,302,807 describes a laminated heating pad with the heater formed of folded aluminum foil with an insulating coating on each surface disposed between a layer of cotton cloth and polyethylene film.

SUMMARY

According to the invention, an electric heating/warming element includes a water-resistant, vapor-permeable bladder within which extends an electrical heating/warming circuit that generates heat when attached to a source of electrical power.

Variations of this aspect of the invention can include one or more of the following features. The electric heating/warming element is adapted to be incorporated, e.g., into articles of clothing, such as jackets, pants, headgear, gloves, footwear, etc.; heating pads and blankets; sports equipments, such as uniforms, helmets, pads, skates and boots, stadium blankets, etc.; medical heating devices; textile home furnishings; etc. The electric heating/warming circuit includes a fabric body with a plurality of spaced apart electrical resistance heating elements incorporated into the fabric body, in the form of conductive yarn, extending generally between opposite edge regions of said fabric body, and electrical conductor elements extending generally along said opposite edge regions of said fabric body and adapted to connect said plurality of spaced apart electrical resistance heating elements to the source of electrical power. The electrical conductor elements are adapted for connecting said plurality of spaced-apart electrical resistance heating elements to a power source of alternating current. The electrical conductor elements are adapted for connecting said plurality of spaced-apart electrical resistance heating elements to a power source of direct current. The power source of direct current includes a battery. A series of at least three electrical resistance heating elements of said plurality of electrical resistance heating elements are symmetrically spaced. A series of at least three electrical resistance heating elements of said plurality of electrical resistance heating elements are asymmetrically spaced. The fabric body includes a knitted body. The fabric body includes a reverse plaited circular knitted body. The fabric body includes a woven body.

Other variations of this aspect of the invention can include one or more of the following features. The bladder includes hydrophilic material and/or hydrophobic material. The bladder has a technical face formed by a stitch yarn and a technical back formed by a loop yarn. The bladder includes a first and a second layer, each of which provides an inner surface of the bladder, the electrical heating/warming circuit being attached to one of said inner surfaces. The electrical heating/warming circuit is printed upon one of the inner surfaces of the bladder. One of the first and second layers of the bladder includes a fabric layer having an inner surface and an outer surface, a barrier layer disposed at the inner surface of the fabric layer, the barrier layer having an inner surface and an outer surface, and the electrical heating/warming circuit in the form of a flexible film disposed upon the inner surface of the barrier layer. The electrical heating/warming circuit is disposed upon the outer surface of the barrier layer. The electrical heating/warming circuit comprises a die-cut, sheet-form metalized layer attached to one of a first and a second broad surface of a fabric body. The electric heating/warming element further includes a phase change component associated with the bladder, the component having a phase change material formulated to change phase in a temperature range of use of the heating/warming element, to cyclically absorb and release latent heat in a manner capable of conserving use of the electrical power source.

The details of one or more embodiments of the invention are set forth in the accompanying drawings and the description below. Other features, objects, and advantages of the invention will be apparent from the description and drawings.

DESCRIPTION OF DRAWINGS

Like reference symbols in the various drawings indicate like elements.

DETAILED DESCRIPTION

Figure 1:
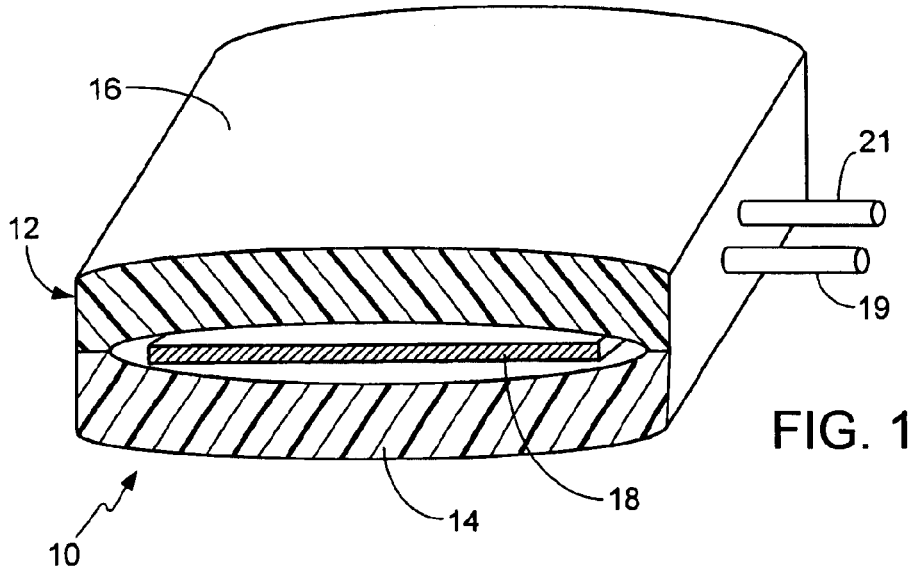
FIG. 1 is a somewhat diagrammatic, perspective, end sectional view of a first embodiment a heating /warming element of the invention.

Referring to FIG. 1, an electric heating /warming element 10 of the invention consists of a bladder 12 formed of opposed layers 14, 16 of a suitable, water-resistant, vapor-permeable (i.e., breathable) polymeric material, e.g., comprising a hydrophobic porous material, such as poly tetra fluoro ethylene (PTFE), or comprising a non-porous hydrophilic material, such as polyurethane, with a heating/warming circuit 18 secured therewithin. The heating/warming circuit 18 is adapted to generate heating/warming when electrical power is applied, e.g. through electrical leads 19, 21.

Figure 2:
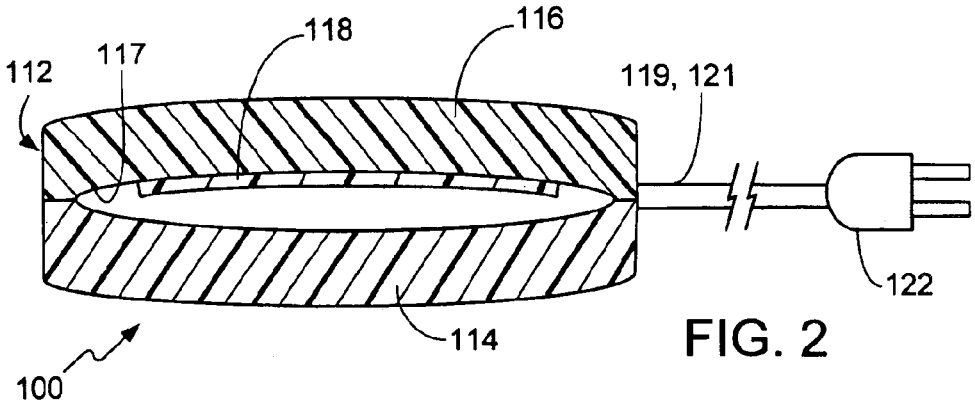
FIG. 2 is a somewhat diagrammatic end sectional view of another embodiment of a heating/warming element of the invention.

Referring to FIG. 2, in a further embodiment, a heating/warming element 100 of the invention consists of a bladder 112 with a flexible heating/warming circuit 118 printed upon an inner surface 117 of one or both layers 114, 116 of suitable water-resistant, vapor-permeable polymeric material forming the bladder 112. For example, the printed circuit 118 maybe formed as described in U.S. Pat. No. 6,111,233; U.S. application Ser. No. 09/389,761, filed Sep. 2, 1999; U.S. Application No. 60/175,202, filed Jan. 10, 2000; and U.S. Application No. 60/261,544, filed Jan. 12, 2001, the complete disclosures of all of which are incorporated herein by reference. The electrical leads 119, 121 terminate, e.g., in a plug 122 for engagement in a wall outlet (not shown) for powering the electrical heating/warming element 100 by alternating current (AC) electrical power.

Figure 3:
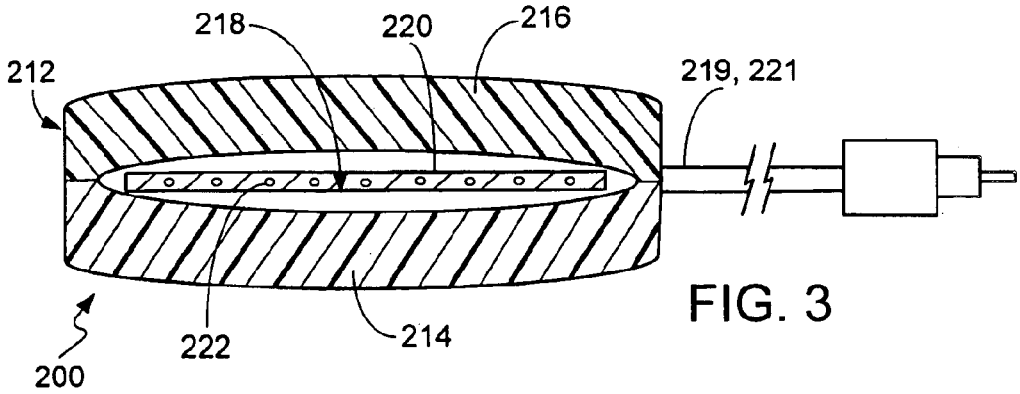
FIG. 3 is a similar view of still another embodiment of a heating/warming element of the invention.

Referring next to FIG. 3, in a further embodiment, the heating warming element 200 of the invention consists of a bladder 212 formed of opposed layers 214, 216 of suitable water-resistant, vapor-permeable polymeric material. The bladder contains a heating/warming circuit 218 in the form of a fabric substrate 220 into which are incorporated conductive yarns 222. For example, the conductive yarns may be incorporated into the fabric body 220 as stitch yarns in a standard reverse plaiting circular knitting (terry knitting) process, e.g., as described in Knitting Technology, by David J. Spencer (Woodhead Publishing Limited, 2nd edition, 1996), the entire disclosure of which is incorporated herein by reference. Preferably, the heating/warming circuit 218 has the form of a parallel electrical circuit, with the conductive yarns 222 connected in parallel along opposite edge regions by conductive buses (not shown), or otherwise as described in U.S. Pat. Nos. 6,160,246; 6,215,111; U.S. application Ser. No. 09/697,100, filed Oct. 26, 2000; and U.S. Pat. No. 6,307,189; the complete disclosures of all of which are incorporated herein by reference. The electrical leads 219, 221 terminate, e.g., in a plug 226 for engagement in an automobile cigarette lighter or other power outlet (not shown) for powering the electrical heating/warming element 200 by direct current (DC) electrical power from the automobile battery.

Figure 4:
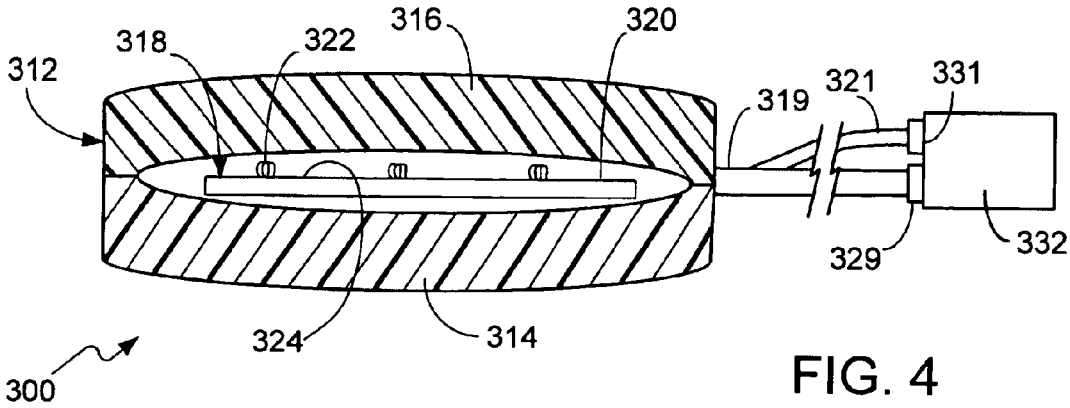
FIG. 4 is a similar view of yet another embodiment of a heating/warming element of the invention.

Referring to FIG. 4, in a further embodiment of the invention, a heating/warming element 300 consists of a bladder 312 formed of opposed layers 314, 316 of suitable water-resistant, vapor-permeable polymeric material. The bladder 218 contains a heating/warming circuit 318 in the form of a substrate 320, e.g., formed of fabric, scrim, etc., with the electrical circuit 318 formed of conductive yarns 322 attached upon one surface 324 (or both surfaces) of the substrate 320. For example, the conductive yarns 322 may be stitched, e.g., embroidery stitched, or otherwise fastened upon surface 324 of the substrate 320, such as described in U.S. application Ser. No. 09/592,235, filed Jun. 12, 2000, the complete disclosure of which is incorporated herein by reference. The electrical leads 319, 321 are connected, e.g., to the terminals 329, 331 of a battery 332 to power the electrical heating/warming circuit by DC power.

Figure 5:
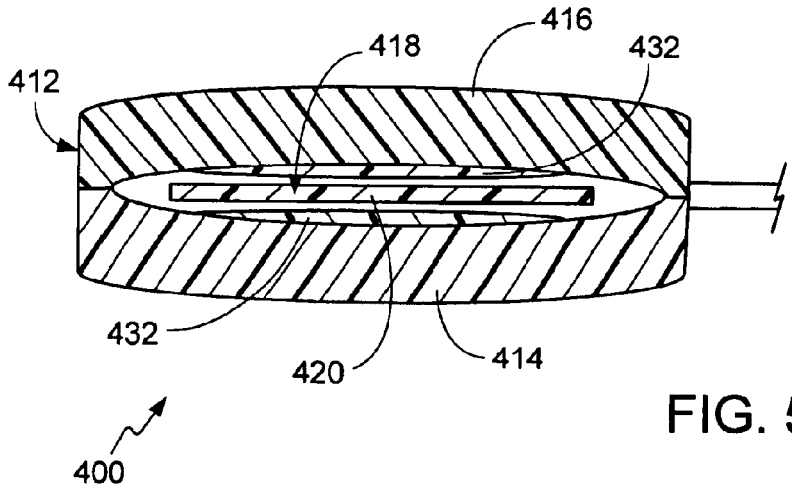
FIG. 5 is a similar view of another embodiment of a heating/warming element of the invention.

Referring to FIG. 5, in an alternative embodiment of a heating/warming element 400 of the invention, e.g., as described above with respect to FIGS. 3 and 4, the bladder 412 contains an electrical heating/warming circuit 418, and further contains a phase change component (indicated generally at 432), as described in U.S. application Ser. No. 09/974,371, filed Oct. 10, 2001; the complete disclosure of which is incorporated herein by reference. The phase change component may be a phase change material incorporated into the fabric substrate 420 or may be affixed thereupon in any suitable manner. For example, a suitable phase change material may be microencapsulated in fibers forming or incorporated into the fabric substrate 420 and/or in fibers of conductive yarns, and/or in a coating or layer applied to the fibers and/or to the fabric substrate. Preferably, the phase change material is selected to absorb and release latent heat by changing phase within the temperature range typical for use of a personal textile electric heating/warming article 400, e.g., such as a heating blanket, a heating pad, an article of apparel, an article of home furnishings or the like, e.g. about 32° F. to about 120° F. Suitable phase change materials may include, e.g., paraffin, glycol, and mixtures or blends of these or other materials, such as available commercially from Outlast, of Boulder, Colo. However, the exact temperature range at which the change of phase may occur can be tailored to different predetermined temperatures by selection of the precise formulation of the phase change material.

A number of embodiments of the invention have been described. Nevertheless, it will be understood that various modifications may be made without departing from the spirit and scope of the invention. Accordingly, other embodiments are within the scope of the following claims.

What is claimed is:

1. An electric heating/warming element comprising:

a bladder of a water-resistant, vapor-permeable polymeric material, and an electrical heating/warming circuit extending within said bladder, wherein said electrical heating/warming circuit generates heat when attached to a source of electrical power, the electrical heating/warming circuit comprising:

a fabric body, incorporated into said fabric body, in the form of conductive yarn, a plurality of spaced apart electrical resistance heating elements extending generally between opposite edge regions of said fabric body, and electrical conductor elements extending generally along said opposite edge regions of said fabric body and adapted to connect said plurality of spaced apart electrical resistance heating elements to the source of electrical power.

2. The electric heating/warming element of claim 1, wherein said electrical conductor elements are adapted for connecting said plurality of spaced-apart electrical resistance heating elements to a power source of alternating current.

3. The electric heating/warming element of claim 1, wherein said electrical conductor elements are adapted for connecting said plurality of spaced-apart electrical resistance heating elements to a power source of direct current.

4. The electric heating/warming element of claim 3, wherein said power source of direct current comprises a battery.

5. The electric heating/warming element of claim 1, wherein a series of at least three electrical resistance heating elements of said plurality of electrical resistance heating elements are symmetrically spaced.

6. The electric heating/warming element of claim 5, wherein a series of at least three electrical resistance heating elements of said plurality of electrical resistance heating elements are asymmetrically spaced.

7. The electric heating/warming element of claim 1, wherein a series of at least three electrical resistance heating elements of said plurality of electrical resistance heating elements are asymmetrically spaced.

8. The electric heating/warming element of claim 1, wherein said fabric body comprises a knitted body.

9. The electric heating/warming element of claim 8, wherein said fabric body comprises a reverse plaited circular knitted body.

10. The electric heating/warming element of claim 9, wherein said fabric body has a technical face formed by a stitch yarn and a technical back formed by a loop yarn.

11. The electric heating/warming element of claim 1, wherein said fabric body comprises a woven body.

12. The electric heating/warming element of claim 1, wherein said bladder comprises a hydrophilic material.

13. The electric heating/warming element of claim 1, wherein said bladder comprises hydrophobic material.

14. The electric heating/warming element of claim 1 incorporated into one of an article of clothing, a heating pad, a blanket, a piece of sports equipment, a medical device and a textile home furnishing.

15. The electric heating/warming element of claim 1, wherein said bladder includes a first and a second layer, each of which provides an inner surface of the bladder, the electrical heating/warming circuit being associated with one of said inner surfaces.

16. The electric heating/warming element of claim 15, wherein said electrical heating/warming circuit is printed upon one of said inner surfaces of said bladder.

17. The electric heating/warming element of claim 15, comprising a fabric layer having an inner surface and an outer surface, wherein said first and said second layers of said bladder comprise:

a barrier layer disposed at each of said inner and outer surface of said fabric layer, said barrier layers each having an inner surface and an outer surface; and said electrical heating/warming circuit in the form of a flexible film disposed upon a said inner surface of a said barrier layer.

18. The electric heating/warming element of claim 1, wherein said electrical heating/warming circuit comprises a die-cut sheet-form metalized layer attached to one of a first and a second broad surface of the fabric body.

19. The electric heating/warming element of claim 1, further comprising a phase change component associated with the bladder and including a phase change material formulated to change phase in a temperature range of use of the heating/warming element, to cyclically absorb and release latent heat in a manner capable of conserving use of the electrical power source.

* * * * *

UNITED STATES PATENT AND TRADEMARK OFFICE

CERTIFICATE OF CORRECTION

PATENT NO. : 6,852,956 B2
DATED : February 8, 2005
INVENTOR(S) : Moshe Rock and Vikram Sharma It is certified that error appears in the above-identified patent and that said Letters Patent is hereby corrected as shown below:

Column 6,
Line 6, replace “fumishing” with -- furnishing --.

Signed and Sealed this

Twelfth Day of July, 2005

JON W. DUDAS
*Director of the United States Patent and Trademark Office*